US007308863B2

(12) United States Patent
de Baan

(10) Patent No.: US 7,308,863 B2
(45) Date of Patent: Dec. 18, 2007

(54) OFFSHORE LNG REGASIFICATION SYSTEM AND METHOD

(76) Inventor: Jaap de Baan, P.O. Box 3102, Hoofddorp (NL) 2130 KC ( * ) Notice: Subject to any disclaimer, the term of this patent is extended or adjusted under 35 U.S.C. 154(b) by 0 days.

(21) Appl. No.: 10/922,634

(22) Filed: Aug. 20, 2004

(65) Prior Publication Data

US 2005/0042035 A1 Feb. 24, 2005

Related U.S. Application Data

(60) Provisional application No. 60/497,290, filed on Aug. 22, 2003.

(51) Int. Cl.
*B63B 35/44* (2006.01)

(52) U.S. Cl. ..... 114/264; 405/195.1

(58) Field of Classification Search ..... 114/230.15, 114/144 B, 264; 441/5, 40; 62/50.2, 53.2, 62/240; 405/224, 169, 172, 195.1, 203, 205, 405/210

See application file for complete search history.

(56) References Cited

U.S. PATENT DOCUMENTS

| | | | | |
|---|---|---|---|---|
| 4,938,630 | A * | 7/1990 | Karsan et al. | 405/224 |
| 6,089,022 | A * | 7/2000 | Zednik et al. | 60/641.7 |
| 6,125,780 | A * | 10/2000 | Sweetman et al. | 114/264 |
| 6,298,671 | B1 * | 10/2001 | Kennelley et al. | 62/50.2 |
| 6,546,739 | B2 * | 4/2003 | Frimm et al. | 62/50.2 |
| 6,598,408 | B1 * | 7/2003 | Nierenberg | 62/53.2 |
| 6,637,479 | B1 * | 10/2003 | Eide et al. | 114/230.1 |
| 6,701,861 | B2 * | 3/2004 | Key et al. | 114/265 |
| 6,829,901 | B2 * | 12/2004 | Harley et al. | 62/53.2 |
| 6,976,443 | B2 * | 12/2005 | Oma et al. | 114/144 B |

* cited by examiner

*Primary Examiner*—Lars A. Olson

(57) ABSTRACT

A system and method for the offshore transfer of liquefied natural gas from an LNG tanker vessel to a moored or dynamically positioned regasification plant is disclosed. Once the state of the natural gas has been changed from liquid to gas or regasified, the natural gas is conveyed to another location in a gaseous state.

2 Claims, 2 Drawing Sheets

OFFSHORE LNG REGASIFICATION SYSTEM AND METHOD

Figure 1:
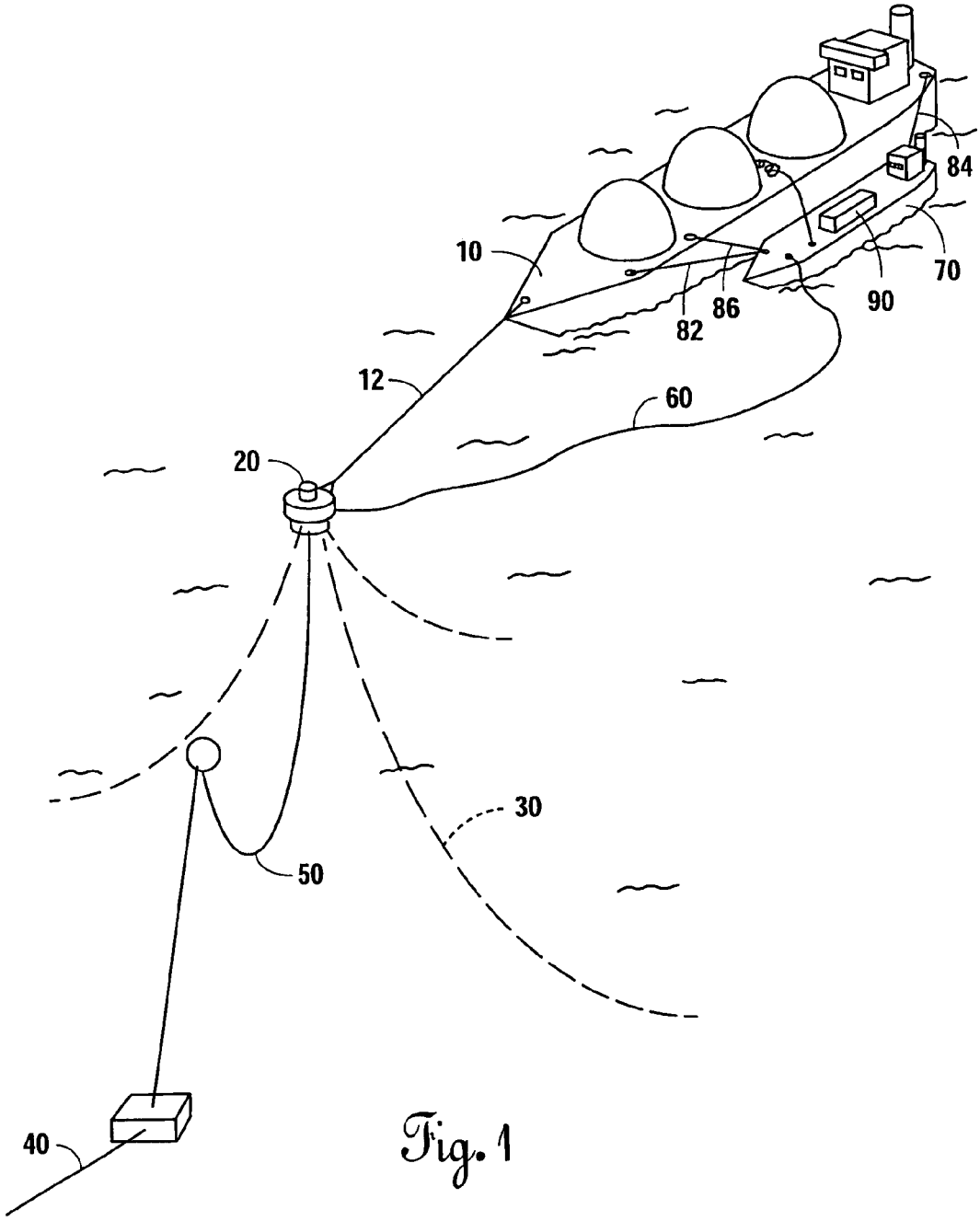

This application claims the benefit of a Provisional U.S. Patent Application filed Aug. 22, 2003 and identified by Ser. No. 60/497,290.

FIELD

The present invention pertains to the transport of natural gas; more particularly, the disclosed invention pertains to the regasification of natural gas transported in a liquid form by ocean-going tankers.

BACKGROUND

Traditionally, tankers used to transport liquefied natural gas (LNG) are off-loaded in protected waters. Once reaching their destination, these LNG tankers are typically moored alongside a quay where the connection of a quay-mounted articulated steel loading arm to the LNG tanker begins the off-loading process of the LNG.

From a safety, efficiency, and cost standpoint, it would be desirable to both off-load the LNG and transform the LNG from a liquid state to a gaseous state at an offshore location; that is, away from protected waters. The natural gas, having now been transformed from a liquid state into a gaseous state, is then readily transportable by an existing natural gas transportation system, such as through undersea pipelines as exist off the coast of the U.S., to an onshore location for temporary storage, further transport inland, processing, and/or use. Despite the increasing use and growing demand for natural gas in response to the escalating cost of oil, and the fact that the volume of natural gas being transported into the U.S. increases the need for an offshore off-loading and regasification system, no commercially viable system for the offshore off-loading and gasification of LNG in unprotected waters is presently available.

Accordingly, a need remains in the art for a system and method which allows conventional LNG tanker vessels of any size or configuration to first moor at an offshore location away from unprotected waters and then discharge their cargo of liquefied natural gas, in its liquefied state, to a regasification plant. Once the LNG has been off-loaded from the tanker vessel, the LNG tanker vessel is then made ready to depart en route to pick up another load of LNG.

SUMMARY

According to the present invention, a system is provided for the offshore off-loading of natural gas in a liquefied form together with a system for the offshore regasification of the liquefied natural gas in unprotected waters. Once the LNG has been transformed into a gaseous state, the natural gas is transportable by a conventional system, such as a pipeline, to an onshore location.

The disclosed system includes a mooring buoy or a mooring system for an LNG tanker vessel. Further included is the necessary pipe and pumping equipment to off-load the LNG from the tanker vessel to a regasification plant on another vessel or floating structure in close proximity to the LNG tanker vessel. The natural gas having now changed state from liquid to gas is either transported to an offshore storage facility or to some type of onshore distribution facility for further distribution.

BRIEF DESCRIPTION OF THE DRAWING FIGURES

Figure 2:
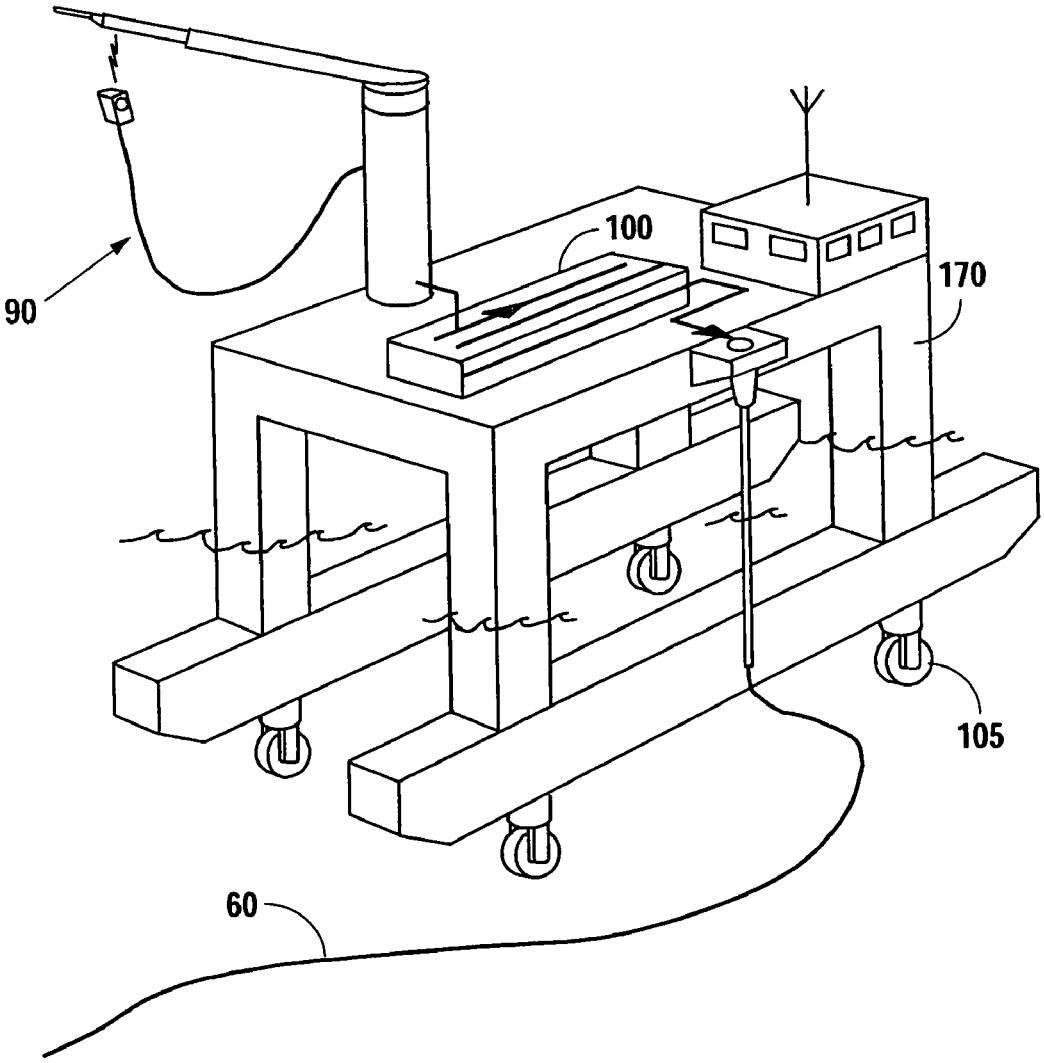

A better understanding of the offshore LNG off-loading and regasification system and method of the present invention for use in unprotected waters may be had by reference to the drawing figures, wherein:

FIG. 1 is a perspective view of an LNG tanker vessel connected to another vessel including a regasification plant; and FIG. 2 is a perspective view of a semi-submersible vessel which may be used for off-loading LNG at an offshore location.

DESCRIPTION OF THE EMBODIMENTS

In the preferred embodiment of the invention as shown in FIG. 1, a large ocean-going LNG tanker vessel 10 is moored by a hawser 12 to a mooring apparatus, such as a CALM buoy 2. While a CALM buoy 20 is shown in FIG. 1, those of ordinary skill in the art will understand that a variety of different mooring systems, to include those which have come to be known as "single point mooring" systems about which large vessels may weather vane as is well known in the art, may be used without departing from the scope of the present invention.

The CALM buoy 20 is anchored to the seabed by anchor legs 30 and connected to a subsea pipeline 40 by a flexible riser 50. A floating hose 60 connects the CALM buoy 20 to another vessel 70 which includes a regasification plant. The vessel 70 including the regasification plant may be moored to the LNG tanker 10 using a traditional side-by-side multiple rope mooring arrangement 82, 84, 86. Alternatively, if the vessel 70 including the regasification plant is fitted with a dynamic positioning system, the traditional side-by-side rope mooring arrangement 82, 84, 86 can be omitted in favor of a system of computer-controlled thrusters which will maintain vessel 70 in the needed location with respect to LNG tanker vessel 10. The system of computer-controlled thrusters can accurately maintain the position of the vessel 70 with respect either to the LNG tanker vessel 10 or with respect to a predetermined point on the earth's surface.

According to the present invention, the transfer of LNG from the LNG tanker vessel 10 to the vessel 70 including the regasification plant is through a flexible pipe 90 in the preferred embodiment. By use of a system of heat exchangers which are part of the regasification plant on board the vessel 70, the temperature of the LNG is caused to increase from about −165° C. to about +5° C. This increase in the temperature of the LNG causes the LNG to change state from a liquid phase to a gaseous or a "dense gaseous" phase.

A pipeline and compressor system on board the regasification vessel 70 is used to raise the pressure of the natural gas to 1000-2000 psi. This pressurization of the natural gas on board the regasification vessel 70 is sufficient to enable the natural gas to flow through the flexible hose 60 in a gaseous state, through the CALM buoy 20, thence through riser 50 and pipeline 40 to another location such as an onshore location for temporary storage, further transport inland, processing, and/or use.

Upon completion of discharge of the LNG from the LNG tanker vessel 10, the flexible pipe 90 is disconnected, the flexible hose 60 is disconnected, and the side-by-side mooring arrangement is disconnected. The vessel 70 containing the regasification plant may then return to an onshore location or the vessel 70 may remain in the offshore area awaiting the arrival of another LNG tanker. Once having off-loaded a predetermined amount of LNG, the LNG tanker 10 departs to another location to off-load more LNG or to pick up a new cargo of LNG.

In another embodiment of the invention, as shown in FIG. 2, the large ocean-going LNG tanker 10 may be connected to an untethered semi-submersible vessel 170. The semi-submersible vessel 170, well known in the offshore drilling industry, is constructed to be located offshore at a substantially constant location. As with vessel 70, a system of computer-controlled thrusters 105 may be used to assure that the semi-submersible vessel 170 stays in the proper location with respect to the large ocean-going LNG tanker 10.

As in the embodiment illustrated in FIG. 1, a flexible pipe 90 is used to transfer the LNG from the LNG tanker vessel to a regasification plant on board the semi-submersible vessel 170. By the use of a regasification plant on board the semi-submersible vessel 170, the natural gas, once having been transformed into a gaseous or "dense gaseous" state, is then caused to flow through a flexible hose 60 into a system which permits the natural gas to flow to another location through a conventional or existing natural gas transportation system.

While the disclosed system has been described according to a preferred and alternate embodiment, those of ordinary skill in the art will understand that numerous other embodiments have been enabled by the foregoing disclosure. Such other embodiments shall be included within the scope and meaning of the appended claims.

I claim:

1. A system for the offshore transfer of liquefied natural gas from an LNG tanker vessel in a liquefied state to a system for moving the natural gas in a gaseous state to another location, said system comprising:

means for the offshore mooring of the LNG tanker vessel;

a pipe for transferring LNG to a regasification plant, said regasification plant being located on a floating structure including a dynamic positioning system to maintain the location of said floating structure with respect to the LNG tanker vessel;

a flexible hose providing a fluid connection from said regasification plant on said floating vessel to a subsea pipeline for moving the natural gas to another location in a gaseous state.

2. A method for the offshore transfer of natural gas from an LNG tanker vessel in a liquid state to system for moving the natural gas to an onshore location in a gaseous state, said method comprising the steps of:

mooring the LNG tanker vessel at an offshore location;

transferring the LNG in a liquid state to a regasification plant, said regasification plant being located on a floating structure including a dynamic positioning system positioned alongside said LNG tanker vessel to maintain the location of said floating structure with respect to said LNG tanker vessel;

providing a flexible hose between said regasification plant and a system for moving the natural gas in a gaseous state using a subsea pipeline to an onshore location.

* * * * *